US005934096A

United States Patent [19]

Munson et al.

[11] Patent Number: 5,934,096

[45] Date of Patent: Aug. 10, 1999

[54] WIRING SYSTEM FOR COMMERCIAL REFRIGERATION

[75] Inventors: Arden L. Munson, St. Louis; Adam Madison, Florissant, both of Mo.

[73] Assignee: Hussmann Corporation, Bridgeton, Mo.

[21] Appl. No.: 08/955,332

[22] Filed: Oct. 21, 1997

[51] Int. Cl.[6] ..... F25D 23/00; H01B 7/00

[52] U.S. Cl. ..... 62/298; 307/147; 439/638; 62/230

[58] Field of Search ..... 62/230, 298, 175, 62/246, 252; 220/3.2, 3.3, 3.94, 3.7, 3.8; 174/57, 59, 60, 65 R, 175, 176, 17 R, 18; 439/170, 171, 172, 173, 638, 652; 307/147

[56] References Cited

U.S. PATENT DOCUMENTS

| | | | |
|---|---|---|---|
| 2,321,999 | 6/1943 | Dalton . | |
| 2,360,304 | 10/1944 | McLoughlin | 174/59 X |
| 2,634,344 | 4/1953 | Robinson, Jr. et al. . | |
| 2,922,054 | 1/1960 | Miller . | |
| 2,994,849 | 8/1961 | Mussari, Jr. . | |
| 3,525,971 | 8/1970 | Glassman . | |
| 3,602,748 | 8/1971 | Locke . | |
| 3,636,495 | 1/1972 | Forsyth, Jr. . | |
| 3,852,701 | 12/1974 | Minitz | 439/638 X |
| 3,965,692 | 6/1976 | Ansted et al. . | |
| 3,991,320 | 11/1976 | Ross | 307/147 X |
| 4,258,969 | 3/1981 | Stallard . | |
| 4,500,796 | 2/1985 | Quin | 307/147 |
| 4,557,114 | 12/1985 | Kato et al. . | |
| 4,815,983 | 3/1989 | Erickson et al. | 437/173 |
| 4,829,779 | 5/1989 | Munson et al. . | |
| 4,937,482 | 6/1990 | Dohogne . | |
| 5,053,637 | 10/1991 | Dillard | 307/147 |
| 5,063,473 | 11/1991 | Hall et al. . | |
| 5,237,826 | 8/1993 | Baldwin et al. | 62/298 X |
| 5,534,760 | 7/1996 | Jung . | |
| 5,622,221 | 4/1997 | Genga, Jr. et al. . | |
| 5,698,820 | 12/1997 | Collard | 220/3.7 X |

*Primary Examiner*—Harry B. Tanner
*Attorney, Agent, or Firm*—Richard G. Heywood

[57] ABSTRACT

A wiring system for commercial refrigeration permits multiple refrigerated merchandisers to be wired on a single electrical circuit from a circuit breaker power source. The hardwiring of the system is done at the factory so that three-phase power connection of the merchandisers to a power source can be accomplished primarily by plug-in connectors at the installation site. Overcurrent protection of the merchandiser components can be provided where electrical power is branched off from a high current feeder line. The wiring system also permits power to be balanced among three phases of electrical power.

24 Claims, 6 Drawing Sheets

WIRING SYSTEM FOR COMMERCIAL REFRIGERATION

BACKGROUND OF THE INVENTION

This invention relates generally to electrical power supply wiring used in commercial refrigeration and more particularly to a wiring system for a line-up of refrigerated merchandisers.

Commercial refrigeration systems are most commonly used, for example, to provide the large refrigeration requirements for a supermarket. In the supermarket example, food is displayed in merchandisers located around the shopping arena of the food store. The merchandisers are generally arranged in line-ups of two or more in which the merchandisers are oriented end-to-end. Most often the in-line merchandisers refrigerate food in the same temperature range, for example, low temperature refrigeration of frozen foods and ice cream at the product temperatures in the range of −20° F. to 0° F., or normal temperature refrigeration of fresh foods including meat, dairy and produce at product temperatures in the range of 28° F. to 50° F. The merchandisers in the same line-up are serviced by a single condensing unit, typically comprising plural multiplexed compressors and a condenser for refrigeration in the particular range. The condensing unit is piped to evaporators in each of the merchandisers in the line-up to achieve the desired refrigeration. It is also known to refrigerate product zones in a merchandiser by absorption refrigeration in which there is no change of phase of the cooling medium in the heat exchanger in the product zone, including secondary coolant systems such as the so-called "glycol-type" system.

The merchandisers have a number of electrical components, including lights, fans, case controllers, solenoid valves, anti-condensate heaters and electric defrost. Not all of the foregoing components will be on every case (for instance, if hot gas or off time is used for defrost), but all cases will have multiple electrical components and there may be still other electrical components provided in the merchandiser.

Installation of the line-up of merchandisers, particularly in a new supermarket, involves not only piping each merchandiser to the condensing unit, but also wiring the merchandisers to a source of electrical power. Presently electrical wiring of merchandisers is complex and time consuming, adding significantly to the time it takes to install the merchandisers and sometimes delaying opening of the supermarket. Electrical wiring is subject to code regulation under the National Electrical Code (NEC), and also to local building codes. Each merchandiser has a data plate describing the electrical requirements of the merchandiser. The data plate will include, for example, values for lights, fan motors, anti-condensate heaters and defrost heaters. A marking for the fan circuit maximum overcurrent protection device will also appear on the plate. Article 422 of the NEC requires all appliances (e.g., a merchandiser) be installed according to the ratings listed on their individual data plates.

A merchandiser, such as a reach-in refrigerator with five doors, will have a 120 volt lighting circuit of 3.2 amperes, a 120 volt fan circuit (including condensate heaters) of 13.5 amperes and a 208 volt defrost circuit of 22.8 amperes. The fan circuit will be limited to no greater than a 20 ampere overcurrent protection device. The lighting circuit is most often made up of fluorescent lamps which are also required to have overcurrent protection of no greater than 20 amperes. The NEC limits the defrost circuit to 1.25 times the defrost amperage (i.e., 28.5 amperes). A typical configuration would be to place three of these merchandisers in a line-up in the supermarket for holding frozen foods and ice cream.

Power for merchandisers in the supermarket is supplied from a circuit breaker box located in a service area or back room, outside the shopping arena of the supermarket. In the example of the low temperature reach-in refrigerators mentioned above, numerous electrical circuits extending from the circuit breaker box to each merchandiser in the line-up would have to be wired. There would be three 30 ampere, 208 volt circuits for the electric defrost (i.e., one circuit for each merchandiser), three 120 volt circuits for the fans/anti-condensate heaters and one 120 volt circuit for the lights of the three merchandisers. Thus, at least seven separate electrical circuits must be brought out to the line-up in this example. When multiplied over the entire supermarket, it is seen that large numbers of wires are present and a large number of hard wire connections must be made by an electrician to complete installation.

The complexity of wiring the power to the merchandisers is further increased by the desire to balance the load as much as possible among the three phases of electrical power which are provided. Frequently, none of the electrical components in the merchandisers require more than single phase power. However, when the merchandisers have electric defrost two phases are wired to the defrost. If all or a substantial majority of the merchandisers are wired to the same phase, there is an unbalance of load among the phases which should be avoided. It is known to balance the load by wiring each case in a line-up to a separate phase. However, because the wiring is done by hard wire connections it is very difficult to keep track of which merchandiser has been wired to which phase. Thus, wiring electrical power to multiple in-line merchandisers is time consuming and complicated.

SUMMARY OF THE INVENTION

Among the several objects and features of the present invention may be noted the provision of a wiring system for a line-up of refrigerated merchandisers which reduces the number of circuits to be brought from the main power supply (i.e., circuit breaker box); the provision of such a wiring system which can be installed rapidly; the provision of such a wiring system which can be installed correctly with a minimum of skill; the provision of such a wiring system which permits balancing of the load among three electrical phases; the provision of such a wiring system which simplifies power balancing; and the provision of such a wiring system which is economical and easy to use.

Generally, the invention is a wiring system for wiring first and second in-line refrigerated merchandisers to a three-phase electrical power source via a feeder line connected to said power source. The feeder line is constructed and arranged for carrying three-phase electrical power greater than the highest maximum electrical current rating of the merchandisers. The merchandisers have separate cooling means serviced from a common cooling source and have separate electrical components with different maximum electrical current ratings. The wiring system comprises first and second tap units respectively associated with the first and second merchandisers and each having a power junction receptacle operatively connected to receive three-phase electrical input by said feeder line from said three-phase power source. The first and second tap units each include overcurrent protection means for its associated merchandisers, and a first multi-positional connector or power coupler having first, second and third terminals operatively wired to receive the three-phase electrical inputs from the power junction receptacle. A correspondingly similar second multi-positional connector or power coupler is constructed and arranged for electrical connection to the electrical components of the associated merchandiser has plural terminals for selective mating connection with different combinations of the first, second and third terminals of said first connector to thereby balance the electrical load from the merchandisers among the three phases of electrical power.

In another aspect of the invention, a line-up of refrigerated merchandiser units commonly serviced by a cooling source and wired in a single electrical circuit from a circuit breaker box generally comprises a first refrigerated merchandiser including a heat exchanger and electrical components having maximum electrical current ratings, and a second refrigerated merchandiser located generally adjacent to the first merchandiser and including a heat exchanger and electrical components having maximum electrical current ratings. The heat exchangers are constructed and arranged for cooling the merchandiser and transferring heat to the cooling source. A feeder power line is constructed and arranged for connection to the circuit breaker box and carries three-phase electrical power in an electrical current greater than the highest maximum electrical current rating of the electrical components of the first and second merchandisers. A first tap unit including a first tap unit box is mounted on the first merchandiser. The first tap unit has an input receptacle in the tap unit box for receiving the feeder line, overcurrent protection means mounted on the first tap unit box, and tap wire means extending from the receptacle and connected to said overcurrent protection means inside of the first tap unit box. A first connector is electrically connected to said overcurrent protection means, and a second connector is constructed and arranged for plug-in connection to the first connector inside of the first tap unit box. A first case power line is electrically connected from the second connector inside the tap unit box to connect to the electrical components of the first merchandiser for providing power to the first merchandiser. A flexible extension feeder line is constructed and arranged for plug-in connection to the input receptacle of the first tap unit for electrical connection with the feeder power line and carries three-phase power from the first tap unit. A second tap unit, including a second tap unit box mounted on the second merchandiser, has an input receptacle constructed and arranged for plug-in connection of the extension feeder line therein, overcurrent protection means mounted on the second tap unit box, and tap wire means extending from the receptacle and connected to the overcurrent protection means inside of the second tap unit box. A first connector or coupler is electrically connected to the overcurrent protection means inside of the second tap unit box. A second connector is constructed and arranged for plug-in connection with the first connector inside of the second tap unit box. A second case power line is electrically connected to the second connector inside of the second tap unit box to connect to the electrical components of the second merchandiser for providing power to the second merchandiser. In this way, the first and second merchandisers are wired in a single electrical circuit from the main feeder line.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
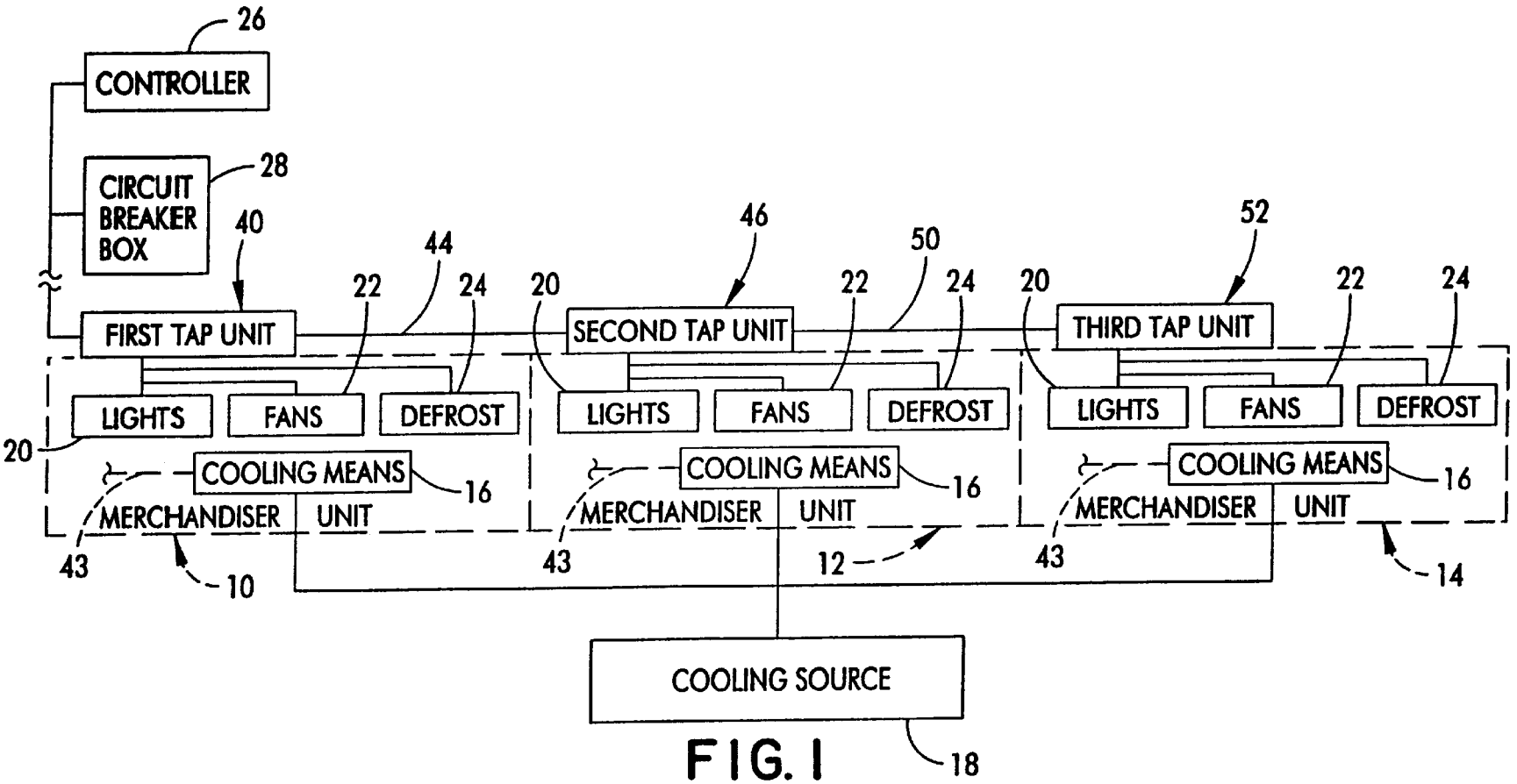
FIG. 1 is a diagrammatic view of an electrical wiring system for a line-up of three refrigerated merchandisers.
Figure 2:
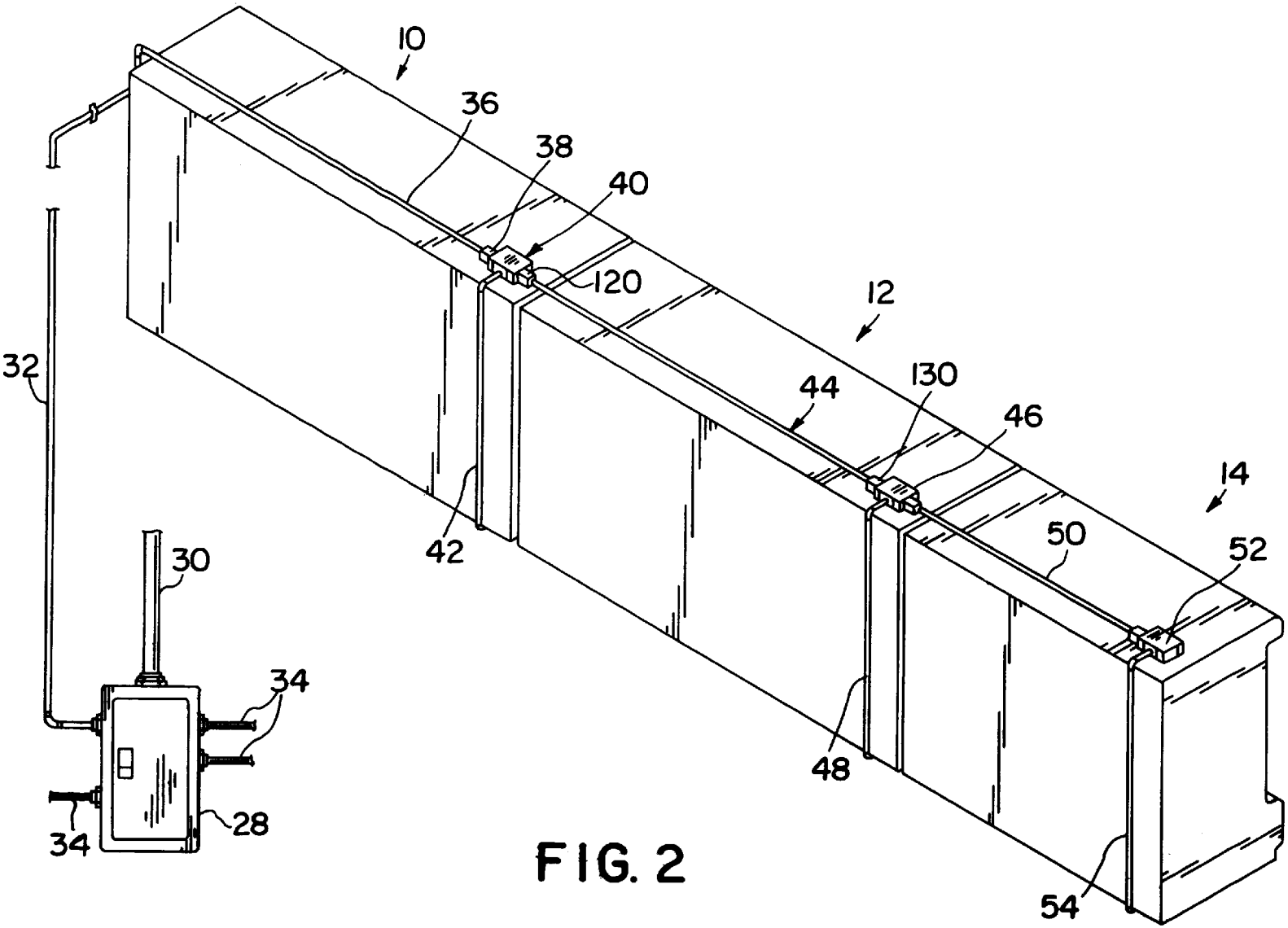
FIG. 2 is a schematic perspective view from the rear of the three refrigerated merchandisers and showing the wiring system.

Referring now to the drawings, and in particular to FIGS. 1 and 2, a line-up of refrigerated merchandisers as in a shopping arena of a supermarket is shown to comprise first, second and third refrigerated merchandiser units (designated generally at 10, 12 and 14). Of course, the principles of the present invention are applicable to line-ups formed of two merchandisers or more than three. Each merchandiser includes cooling means 16, such as one or more evaporator coils, which are piped in parallel with each other and with the evaporator coils of the other merchandisers in the line-up to a common cooling source 18 (e.g., a condensing unit) for refrigerating the merchandisers. The cooling source 18 can be located in a back room or next to the line-up in a shopping arena. Although traditional vapor compression refrigeration of the merchandisers 10, 12, 14 is contemplated in the preferred embodiment, absorption cooling (especially using secondary coolants such as glycol-type fluids) may be employed in the merchandisers in which there is no phase change of the cooling medium.

The merchandisers 10, 12, 14 have electrical components, including lights 20, fans 22 and electric defrost 24 which are diagrammatically illustrated in FIG. 1. The merchandisers also include anti-condensate heaters which would be electrically wired together with the fans 22 and are not shown. Although electric defrost 24 is illustrated, it is to be understood that other forms of defrost may be used, such as hot gas or off time. In addition, a master controller 26, typically located outside the shopping arena, is connected to the merchandisers 10, 12, 14 to control their operation. The controller 26 energizes and de-energizes the lights 20, fans 22 and electric defrost 24 in the merchandisers.

Power for the electrical components of the merchandisers 10, 12, 14 comes from a power source (not shown) to a circuit breaker box 28 in the supermarket back room or service area. The circuit breaker box 28 is connected to the power source by a line illustrated in FIG. 2 as conduit 30. To connect the line-up of merchandisers 10, 12, 14 to the power source, a single feeder line 32 is attached in a conventional manner to the circuit breaker box 28 in electrical connection with the power source and extends to the case line-up. As shown in FIG. 2, other feeder lines 34 constructed and arranged for supplying electrical power elsewhere in the supermarket, such as for other merchandiser line-ups (not shown), are also connected to the circuit breaker box 28.

In the illustrated embodiment, the feeder line 32 is hard-wired into connection with a flexible connector line 36 adjacent to the merchandiser line-up. The connector line 36 constitutes part of the feeder line 32 in the preferred embodiment. The free end of the connector line 36 has a plug 38 which is plugged into a first tap unit (indicated generally at 40) mounted on the first merchandiser 10. It is envisioned that other connections of the feeder line 32 to the first tap unit 40 could be made, such as providing a coupler or disconnect plug (not shown) at the free end of the feeder line or providing a junction box (not shown) to which the feeder line would be hardwired. In the latter instance, the connector line 36 would have a plug at both ends for plugging into the junction box and the first tap unit. As described in detail hereinafter, electrical power is tapped from the feeder line 32 or its connector line 36 within the first tap unit 40. The tapped electricity is carried by a first case power line 42 to the electrical components (20, 22, 24) of the first merchandiser 10. Control signal wiring from the controller 26 (FIG. 1) is carried with on in the feeder line 32 to the tap unit 10 and is also tapped and carried to the case electrical components. It is contemplated that the controller 26 could also be used to control coolant valves associated with the cooling means 16. The possible tap connection of the controller 26 to the cooling means 16 is indicated by broken dashed lines 43 extending from the cooling means in FIG. 1.

A first extension feeder line, generally indicated at 44, is plugged into the first tap unit 40 and extends over the top of the second merchandiser case 12 to a second tap unit 46 mounted on the second merchandiser. The first extension feeder line 44 is constructed and arranged to carry full electrical current at the same amperage as the feeder line 32 and is plugged into the second tap unit 46. Electrical power and control signals are tapped from the first extension feeder line 44 to the second merchandiser 12 within the second tap unit 46 and carried to the electrical components (20, 22, 24) of the second merchandiser through a second case power line 48. A second extension feeder line 50 is plugged into the second tap unit 46 and extends to a third tap unit 52 mounted on the third refrigerated merchandiser 14. The second extension feeder line 50 is constructed and arranged to carry the same high current as the feeder line 32 and is plugged into the third tap unit 52. The electrical power and control signal tapped from the second extension feeder line 50 within the third tap unit 52 are carried from the third tap unit through a third case power line 54 to the electrical components (20, 22, 24) in the third merchandiser unit 14. In this way the three refrigerated merchandiser units 10, 12, 14 are connected in a single electrical circuit extending from the circuit breaker box 28. The connector line 36 may be of substantially identical construction as the first and second extension feeder lines 44, 50 and each includes six wires (see FIG. 3), one for each of the three phases of electrical power supplied from the power source, a ground wire, a neutral wire and a control wire.

The feeder line 32/36 and extension feeder lines 44, 50 will be rated for 60 or 100 amperes, which is substantially higher than the rating for any of the electrical components (20, 22, 24) in the merchandisers. The maximum current rating for the lights 20 and fans 22 is typically about 20 amperes and the current rating for the electric defrost 24 is about 30 amperes. Accordingly, it is necessary to tap the feeder line 32/36 and extension feeder lines 44, 50 with the proper overcurrent protection for the electrical components.

Figure 4:
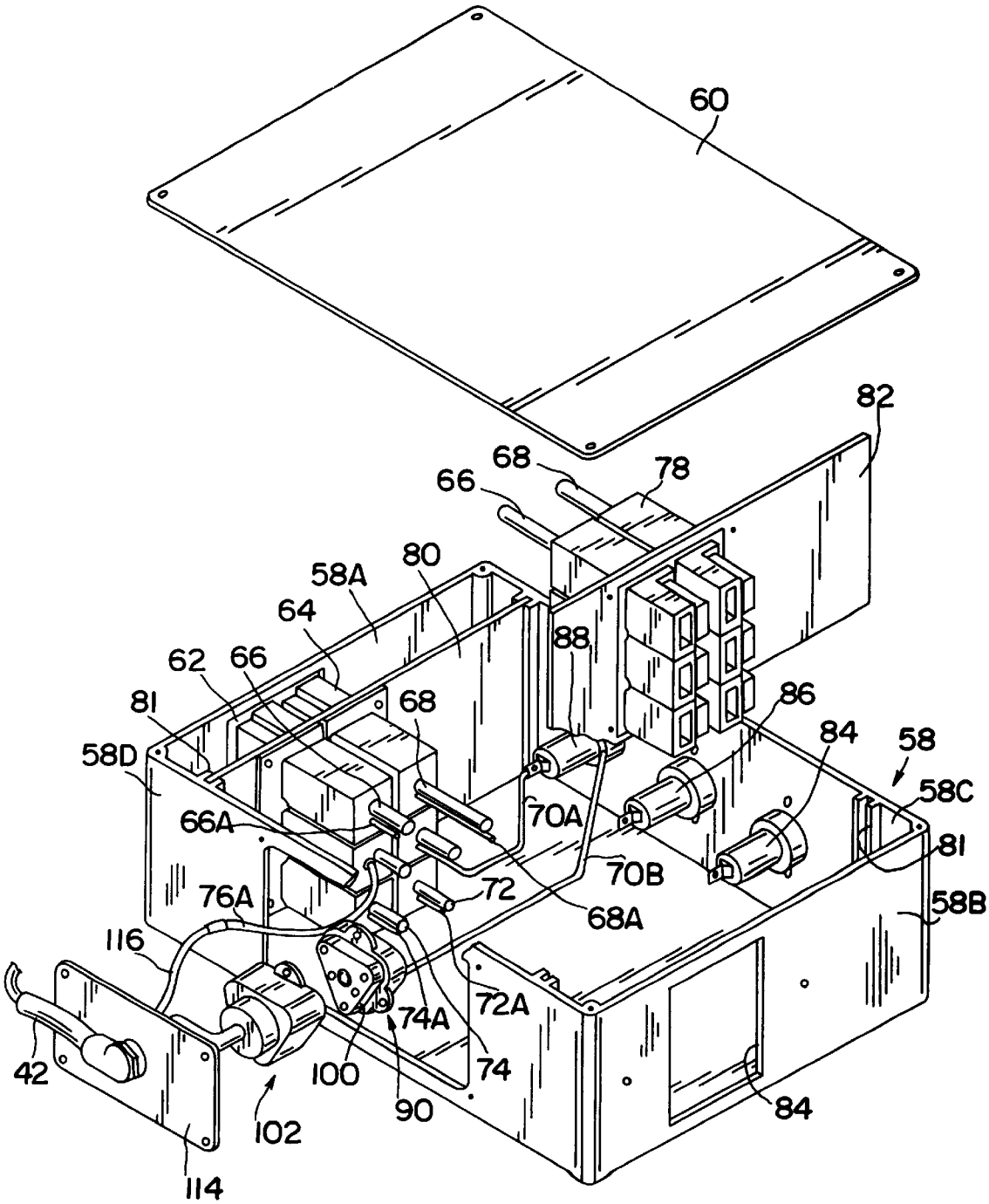
FIG. 4 is a fragmentary, partially exploded perspective of a tap box unit of the wiring system.

The construction of the tap units 40, 46, 52 is substantially identical. Accordingly, a detailed description of only the first tap unit 40 will be given. Referring to FIG. 4, the first tap unit comprises a junction receptacle box, generally indicated at 58, including a removable lid 60. The junction receptacle box 58 has opposed pairs of walls 58A, 58B and 58C, 58D. An opening 62 in a wall 58A of the box 58 provides access from the box exterior to an electrical input receptacle 64 constructed and arranged for plug-in connection of the connector line 36. Similarly, the opposed wall 58B has an opening 84 to provide access to an electrical output receptacle 78 that is substantially identical to input receptacle 64. The input and output receptacles 64, 78 are mounted on support walls 80, 82 that bridge across and are keyed into channel means 81 provided on the opposed walls 58C, 58D. It will be seen in FIG. 4 that the support wall 82 and output receptacle 78 mounted therein are shown exploded upwardly from the first tap unit box 58, but the input and output receptacles 64, 78 will be mounted in-line across the box and be accessible through the openings 62, 84, respectively. The plug 38 of the connector line 36 (FIG. 2) can be pushed through the opening 62 for mating engagement with the input receptacle 64. In the preferred embodiment, the plug 38 and input receptacle 64 are constructed from POWER-POLE® modular connectors manufactured by Anderson Power Products of Sterling, Me. The connectors are six line coupling means for connecting the six wire leads from the feeder line 36 (i.e., three three-phase lines, a ground wire, a neutral wire and a control wire) and attach together in a block forming both the plug 38 and the input receptacle 64. The connector plugs for each wire are of identical construction, but can be plugged into each other individually or joined together, as with the plug 38 and input receptacle 64. It is to be understood that plugs and receptacles of other configuration or construction (not shown) may be employed without departing from the scope of the present invention.

Inside the first tap unit box 58, there is a wire for each of the three phases (designated 66, 68 and 70, respectively), a ground wire 72, a neutral wire 74 and a control wire 76 connected to the input receptacle 64 and extending through the first tap unit 40 to the output receptacle 78. The wires 66, 68, 70, 72, 74 and 76 have been broken off adjacent to the input receptacle 64 for clarity of illustration.

The wires 66, 68, 70 for the three phases, ground wire 72 and neutral wire 74 are internally tapped by corresponding first tap wires (designated 66A, 68A, 70A, 72A and 74A, respectively) which extend outwardly from the input receptacle 64. The first tap wires 66A, 68A, 70A from the wires 66, 68, 70 carrying the three phases of electrical power extend from the input receptacle 64 to respective fuses (designated 84, 86 and 88, respectively) mounted in the wall 58C of the first tap unit box 58. Only one of the first tap wires 70A is shown connected to one of the fuses 88 in FIG. 4 for clarity of illustration, the connections of the other first tap wires 66A, 68A to their corresponding fuses 86, 88 being readily apparent. In the illustrated embodiment, all three fuses will be 30 ampere to permit sufficient current to pass for operation of the electric defrost 24 in the first refrigerated merchandiser 10. Where electric defrost is used, separate 20 ampere overcurrent protection devices (not shown) are incorporated into the merchandisers 10, 12, 14 in a known way during their manufacture to meet code requirements for the lights 20 and fans 22.

Second tap wires 66B, 68B and 70B (FIG. 7) extend from each of the fuses 84, 86, 88 to a first multi-positional connector or coupler, generally indicated at 90, having a generally equilateral triangular shape. Only one of the second tap wires (70B) is illustrated in FIG. 4 for clarity; the connection of second tap wires 66B, 68B from their respective fuses 86, 88 to the first connector 90 being readily apparent. Tap wires 72A, 74A from the ground wire 72 and the neutral wire 74, respectively, extend from the input receptacle 64 directly to the first connector 90. The second tap wires 66B, 68B, 70B are electrically connected to respective female line contacts 92 (at A, B and C in FIG. 5) located in the three corners of the coupler. The tap wire 72A from ground is electrically connected to a ground contact 94 located in the center of the connector 90 and the tap wire 74A from neutral is connected to two neutral contacts 96 located on adjacent sides of the triangle equidistant between contacts 92. The coupler 90 is also formed with a hole 98 on a third side of the triangle which does not provide any electrical connection but accommodates a male contact in certain positions of the connector assembly. The female line contacts 92, 94, 96 and hole 98 are all disposed in a projecting triangular block or male plug portion 100 of the connector 90.

Figure 6:
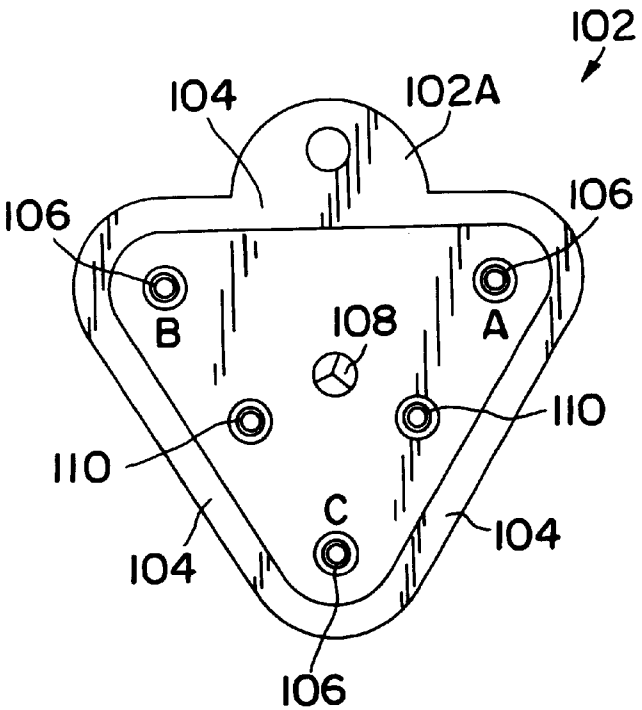
FIGS. 5 and 6 are elevational views of the opposing mating faces of male and female couplers of the tap unit.

The first tap unit 40 further includes a second multi-positional connector or coupler, generally indicated at 102, having a generally equilateral triangle shape corresponding or similar to the shape of the male plug 90. Referring to FIG. 6, the second connector 102 has a recessed central region surrounded by triangularly arranged walls 104 to receive the male block 100 of the first coupler 90 therein. Male electrical contacts disposed in the central region include three line contacts 106 disposed at A, B and C in respective corners of the triangle, a central ground contact 108 and two neutral contacts 110 located along two adjacent sides of the triangle. The line contacts 106 in the corners of the triangle are each constructed and arranged to carry one of the three phases of electrical power. All of the contacts 106, 108, 110 of the second connector 102 have associated wires 106A, 108A, 110A, respectively, (FIG. 7) extending from the second connector and forming part of the first case power line 42. The first case power line coupler 90, 102 is attached to the first tap unit box 58 by a plate 114, which is shown exploded from the first tap unit box in FIG. 4. Inside the first merchandiser 10, the wire provided for carrying one phase of the electricity is branched off to the lights 20 and fans 22. The other two wires, provided for carrying the other two phases, are connected to the electric defrost 24, and all electrical components are connected to ground and neutral. The connections from the first tap unit 40 to the electrical components are illustrated diagrammatically in FIG. 1.

Figure 7:
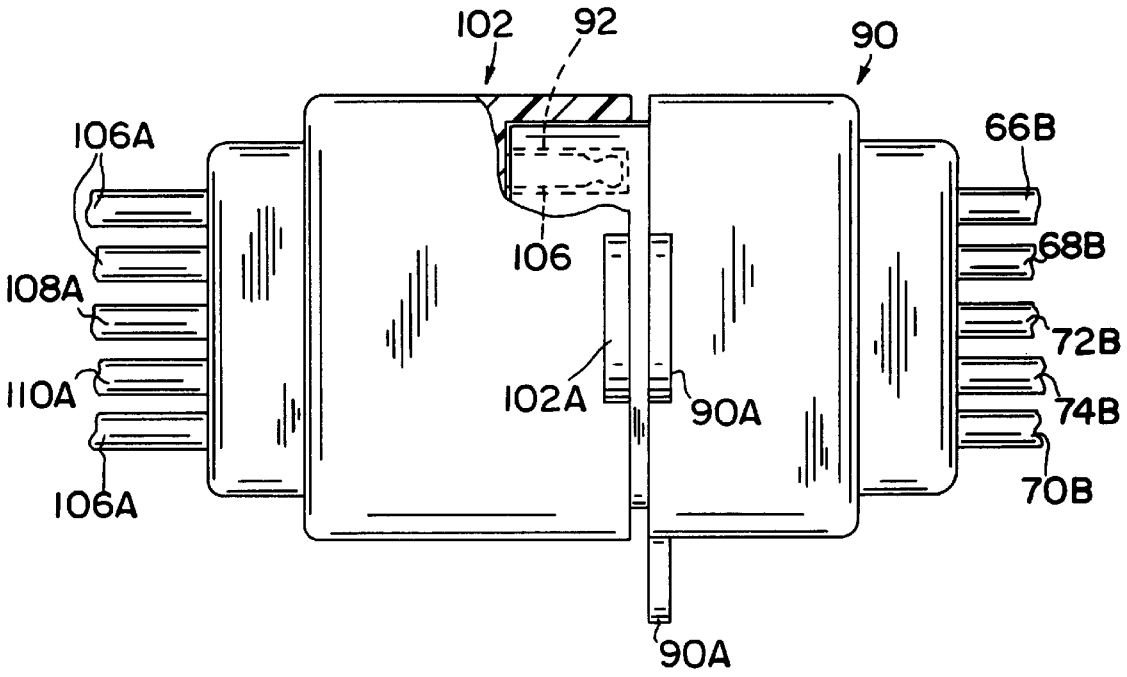
FIG. 7 is a side elevation of the plugs connected together, and being partially broken away to show internal details.

The first and second connectors 90, 102 are capable of being selectively plugged into each other as illustrated in FIG. 7 in one of three positions. One of three ears or tabs 90A on the first connector 90 will be aligned with an assembly ear or tab 102A on the second connector 102 when they are plugged into each other in the selected position to permit the insertion of a fastener (not shown). The projecting portion or boss 100 of the first connector 90 is received inside the walls 104 into the central recessed region of the second connector 102. The male contacts 106, 108, 110 of the second connector 102 are received in the female socket contacts 92, 94, 96 of the first connector 90. This interconnection of one mating pair of line contacts (92, 106) is shown in hidden lines in FIG. 7.

Figure 5:
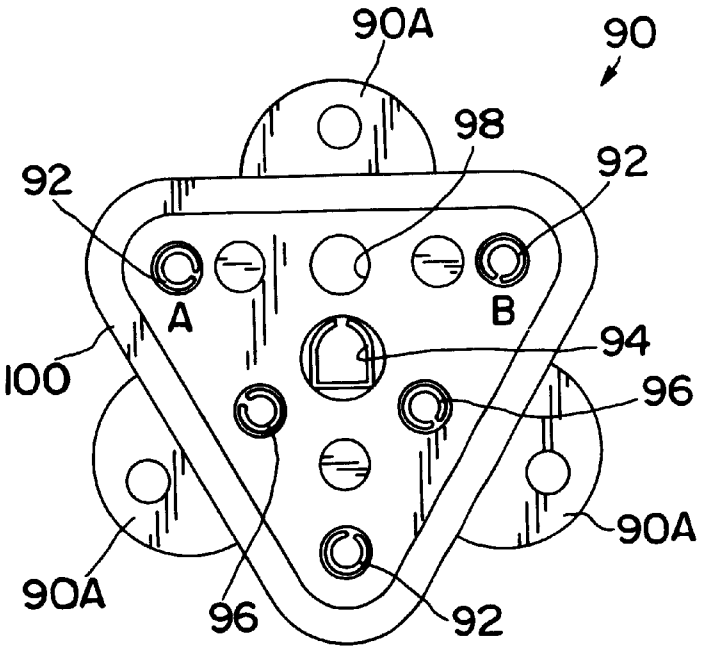

It is readily apparent from FIGS. 5 and 6 that the first male connector 90 and second female connector 102 may be coupled together in any one of three different orientations as a result of their triangular configurations. Thus, each of the three phases of electrical power input through the tap unit and provided at the male connector can be selectively connected to any one of the three male line contacts 106 of the second connector 102. An installer can choose which phases of the electrical power will be sent to the lights 20 and fans 22 and which to the electric defrost 24 by simple rotation of the connectors 90, 102 relative to each other. The first and second connectors are marked adjacent each of the three line contacts 92, 106 in the corners with a letter (A, B and C). Each merchandiser 10, 12, 14 is wired so that the same electrical components (20, 22, 24) from the merchandiser are connected to the line contact 106 having the same letter designation. An installer can readily make note that a connection of A to A, B to B, C to C was made in the first tap unit 40 so that the connectors (not shown) of the second tap unit 46 will be oriented to make a different power connection of A to B, B to C, C to A and so on for the third tap unit 52.

Regardless of the orientation in which the first connector 90 and male connector 102 are connected together, the ground contact 108 of the second connector will be received in the ground contact 98 of the first connector because of the central location of the contacts. The neutral tap wire 74A is in electrical contact with both of the neutral contracts 96 so that at least one of the neutral contacts 110 of the second connector 102 will be received in one of the neutral contacts 96 of the first connector 90. Electrical connection of the neutral contacts 96, 110 is assured because of the presence of two contacts located in the middle of two sides of each triangular connector. The hole 98 on the third side of the first connector 90 is sized for receiving one of the male neutral contacts 110 when the first and second connectors 90, 102 are so oriented as to align one or the other of the neutral contacts of the second connector with the hole.

Referring again to FIG. 4, the control wire 76 is tapped at the input receptacle 64 by a control wire tap 76A, and also extends through the first tap unit box 58 to the output receptacle 78. The control wire tap 76A is plugged into an input control wire 116 which bypasses connector plug 90, 102 and extends into the first case power line 42 and into the first merchandiser 10. As may be seen, the connection of the control wire tap 76A to the input control wire 116 is not made through the first and second connectors 90, 102. However, it is envisioned that the connection of the control wire tap 76A to the input control wire 116 could be incorporated into the connectors 90, 102 without departing from the scope of the present invention, as by providing a co-axial ground and control wire cable at the center 94, 108.

Figure 3:
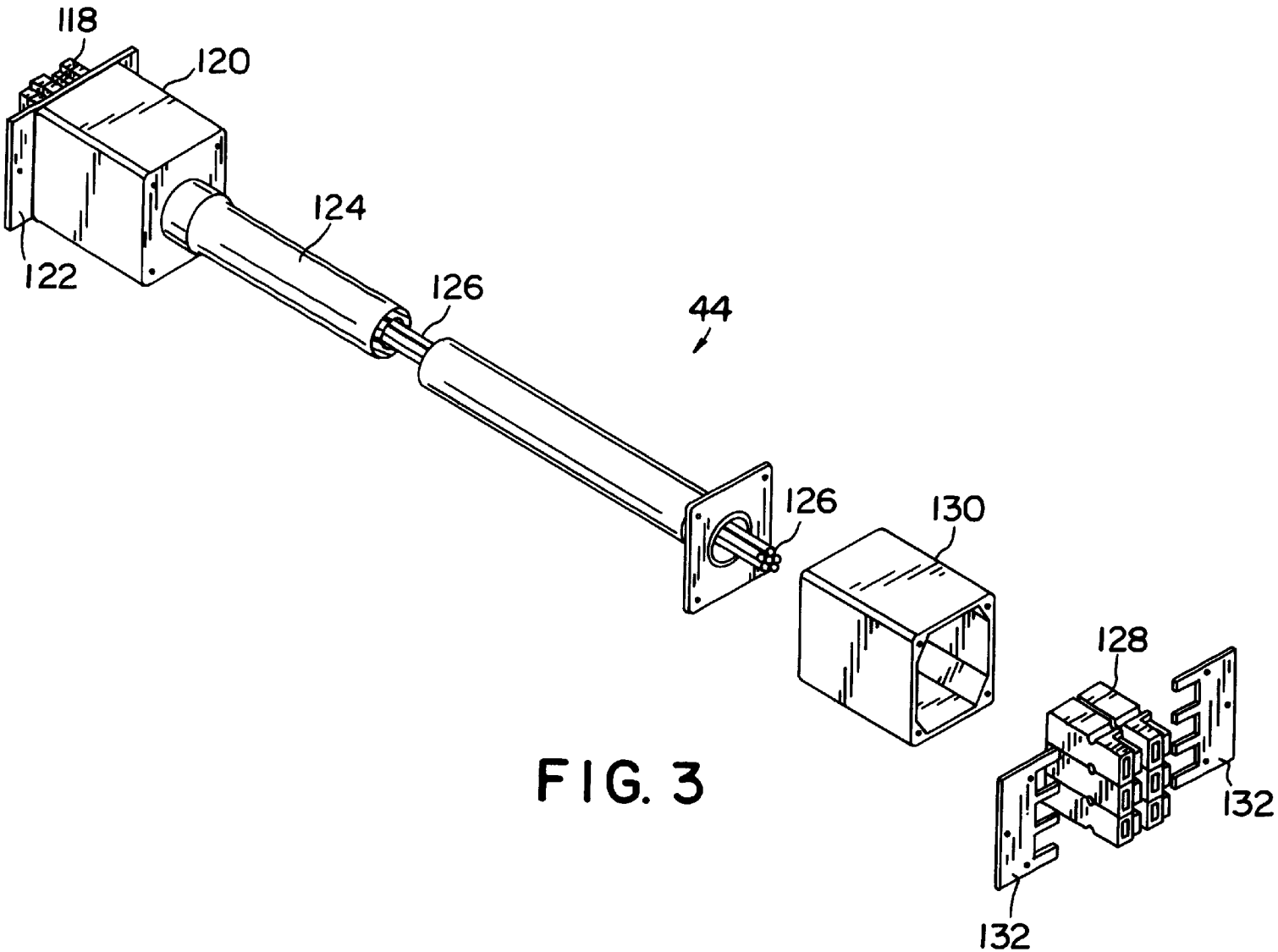
FIG. 3 is a fragmentary, partially exploded perspective of a feeder line extension of the wiring system.

The first extension feeder line 44 is plugged into the output receptacle 78 of the first tap unit 40 and extends to the second tap unit 46 where it plugged into an input receptacle (not shown) of identical construction to the input receptacle 64 of the first tap unit. As shown in FIG. 3, the first extension feeder line 44 comprises a first plug 118 of the same construction as the input and output receptacles 64, 78 of the first tap unit 40. The first plug 118 is received in a housing 120 having a mounting faceplate 122 for opening 84. The housing 120 is connected to a flexible conduit 124 which can be made of a flexible metal construction, or of a polymeric material. The first plug 118 is connected to extension feeder wires 126, each corresponding to one of the wires 66, 68, 70, 72, 74 and 76 in the first tap unit 40. The extension feeder wires 126 are sized to carry the same amperage as the feeder line 32 and line 36. The extension feeder wires 126 terminate in a second plug 128 of the first extension feeder line 44. The second plug 128 is also received in a housing 130 including a faceplate 132. The second plug 128, housing 130 and faceplate 132 are shown exploded from the flexible conduit 124 in FIG. 3.

The second plug 128 of the first extension feeder line 44 is plugged into the input receptacle (e.g., 64) of the second tap unit 46. As previously stated, the construction and arrangement of the interior of the second tap unit 46 is identical to that of the first. The first and second connectors (not shown) in the second tap unit 46 can be plugged together in the same way as those of the first tap unit 40. Preferably, the electrical connections would be such that different phases of the electrical power would be connected to the lights 20, fans 22 and electric defrost 24. The second extension feeder line 50 extends from the second tap unit 46 to the third tap unit 52 and is of identical construction to the first extension feeder line 44.

The internal construction of the third tap unit 52 is also identical to that of the first tap unit 40. However, in a three merchandiser line-up the output receptacle 78 (present in the first tap unit) is not needed and may be removed. The electrical connections in the third tap unit 52 can be made in the same was as those of the first and second tap units 40, 46. Preferably, the first and second connectors (90, 102) are connected together so that the three phases of electrical power are connected to the lights 20, fans 22 and electric defrost 24 in a configuration which is different from both the first tap unit 40 and the second tap unit 46. The third tap unit 52, because it is the last unit in the line-up of the illustrated embodiment, does not require an output receptacle and its exit opening (84) is closed off.

Thus, it may be seen that the several objects and features of the present invention are achieved by the wiring system. The three merchandisers 10, 12, 14 in a line-up can be branch wired by way of the tap units 40, 46, 52 from a single feeder line 32/36 extending from a remote circuit breaker box 28, as in a back room of a food store. Thus the merchandisers 10, 12, 14 are conveniently wired on a single circuit, reducing the number of separate wires needed and decreasing the complexity of wiring the merchandisers. The opportunity for error is reduced so less skill is required in wiring the merchandiser units 10, 12, 14. In addition, the merchandisers can be wired much more rapidly while still meeting code requirements. The tap units 40, 46, 52 contain fuses (e.g., fuses 84, 86, 88) which provide overcurrent protection for the highest rated electric component (e.g., 30 amperes for electric defrost 24) in the merchandiser. The flexibility of the connector line 36 and extension feeder lines 44, 50 permits the connections to be made at different locations on and around the merchandisers 10, 12, 14. In that regard, it is envisioned that the tap units 40, 46, 52 could be mounted other than on top of the merchandisers.

The wiring system of the present invention makes it easier to balance the load of the merchandiser units 10, 12, 14 among the three phases of electrical power supplied. The first and second connectors 90, 102 of the first tap unit 40 can be plugged together in a first orientation (e.g., A to A, B to B, C to C) so that a first phase of power is sent to the lights 20 and fans 22 while second and third phases of power are sent to the electric defrost 24. In the second tap unit, the connectors may be connected (e.g, A to B, B to C, C to A) so that the second phase is sent to the lights 20 and fans 22 while the first and third phases are supplied to the electric defrost 24. Finally, in the third tap unit the connectors are connected (e.g., A to C, B to A, C to B) so that the third phase is sent to the lights 20 and fans 22, and the first and second phases are supplied to the electric defrost 24. It will be apparent that no one phase will be loaded to a grossly greater degree than the other two in the case line-up. Accordingly, it is not necessary to use as large of wire in the feeder line 32 to account for extraordinarily high loads on any one phase.

Frequently some form of defrost (e.g., off time, hot gas) other than electric defrost will be used in the merchandisers. In that event, only a single phase of electrical power need be tapped off to each merchandiser. The fuses in the tap units would be 20 ampere rated for the lights and fans, and no additional overcurrent protection in the merchandiser would be required. It is to be understood that the loads may not be identical among the phases, particularly when there are greater or fewer than three merchandisers and also when electric defrost is employed. However, no one phase is subject to a vast majority of the load when balancing can be so easily accomplished.

As various changes could be made in the above constructions without departing from the scope of the invention, it is intended that all matter contained in the above description or shown in the accompanying drawings shall be interpreted as illustrative and not in a limiting sense.

What is claimed is:

1. A wiring system for wiring first and second in-line refrigerated merchandisers to a three-phase electrical power source via feeder line means connected to said power source and being constructed and arranged for carrying three-phase electrical power greater than the highest maximum electrical current rating of the merchandisers, the merchandisers having separate cooling means serviced from a common cooling source and each having separate electrical components with maximum electrical current ratings, said wiring system comprising:

first and second tap units respectively associated with the first and second merchandisers and each having a power junction receptacle operatively connected to receive three-phase electrical input by said feeder line means from said three-phase power source, each of the tap units including first multi-positional connector means having first, second and third terminals operatively wired to receive the three-phase electrical inputs from the power junction receptacle, and a correspondingly similar second multi-positional connector means constructed and arranged for electrical connection to the electrical components of the associated merchandiser and having plural terminals for selective connection with different combinations of said first, second and third terminals of said first connector means to thereby accommodate the balancing of the electrical loads from the merchandisers among the three phases of electrical power.

2. The wiring system of claim 1, wherein the first, second and third terminals are constructed and arranged in said connector means in an equidistant triangulation from each other.

3. A wiring system as set forth in claim 2 wherein the first and second connector means are generally triangular in shape and constructed and arranged for plug-in connection to each other in any of three relative orientations.

4. A wiring system as set forth in claim 3 wherein the first connector means are differently marked adjacent to each terminal to designate which phase of power is connected to the terminal.

5. A wiring system as set forth in claim 4 wherein the second connector means are differently marked adjacent to each terminal.

6. A wiring system as set forth in claim 5 wherein the terminals comprise line contacts, the first and second connector means each further comprising an electrical ground contact located generally in the center of the first and second electrical connectors whereby the ground contact of the first connector makes electrical contact with the ground contact of the second connector regardless of the selective orientation of the first and second connector means.

7. A wiring system as set forth in claim 6 wherein the first and second connector means of the first and second tap units each still further comprise a pair of electrical neutral contacts, each neutral contact being located between a respective pair of the line contacts whereby at least one of the neutral contacts of the first connector means makes electrical contact with one of the neutral contacts of the second connector regardless of the selective orientation of the first and second connectors as plugged into each other.

8. A wiring system as set forth in claim 1 further comprising extension feeder line means constructed and arranged for plug-in connection to the first and second tap units for carrying the three phase input from the first tap unit to the power junction receptacle of the second tap unit.

9. A wiring system as set forth in claim 8 wherein the extension feeder line means comprises a flexible conduit and electrical wiring disposed in the conduit carrying the three-phase input.

10. A wiring system as set forth in claim 1 wherein the first and second tap units each comprise a tap unit box constructed and arranged for housing the first and second connector means.

11. A wiring system as set forth in claim 1 including overcurrent protection means constructed and arranged in said junction receptacle and being interposed in the operative connection of said three power phases to said first connector means.

12. A line-up of refrigerated merchandisers commonly serviced by a cooling source and wired in a single electrical circuit from a circuit breaker box, the line-up comprising:

a first refrigerated merchandiser including a case cooling heat exchanger and electrical components having maximum electrical current ratings;

a second refrigerated merchandiser located generally adjacent to the first merchandiser, the second merchandiser including a case cooling heat exchanger and electrical components having maximum electrical current ratings;

feeder line means constructed and arranged for connection to the circuit breaker box for carrying three-phase electrical power in an electrical current greater than the highest maximum electrical current rating of the electrical components of the first and second merchandisers;

a first tap unit associated with the first merchandiser and having an input receptacle for receiving the feeder line, a first multi-positional connector and tap wire means extending from the first input receptacle and connected to said first multi-position connector, the first connector having three first line contact means disposed in equal triangulation and being electrically connected to a respective one of the three phases of electrical power, a second multi-position connector having second line contact means disposed in equal triangulation corresponding to said first line contact means, the first and second connectors being constructed and arranged for plug-in connection whereby any one of the line contact means of the first connector may be selectively connected to any one of the line contact means of the second connector;

a first case power line electrically connected to the second connector and to the electrical components of the first merchandiser for providing power to the first merchandiser;

extension feeder line means extending from the first tap unit and being electrically connected through said input receptacle to the feeder line means for carrying the three-phase power from the first tap unit;

a second tap unit associated with the second merchandiser and having a second input receptacle for receiving the extension feeder line means from the first tap unit, a third multi-positional connector and tap wire means extending from the second input receptacle and connected to said third multi-position connector means, and the third connector means having three third line contact means disposed in equal triangulation and being electrically connected to a respective one of the three phases of electrical power, a fourth multi-position connector having fourth line contact means disposed in equal triangulation corresponding to said third line contact means, the third and fourth connectors being constructed and arranged for plug-in connection whereby any one of the line contact means of the third connector may be connected to any one of the line contact means of the fourth connector;

a second case power line electrically connected to the fourth connector means and to the electrical components of the second merchandiser for providing power to the second merchandiser;

whereby the first and second merchandisers are wired in a single electrical circuit from the circuit breaker box.

13. The merchandiser line-up of claim 12, wherein overcurrent protection means is interposed in said tap wire means of the first and second tap units.

14. The merchandiser line-up of claim 12 further comprising:

a third refrigerated merchandiser located generally adjacent to one of the first and second merchandisers, the third merchandiser including a case cooling heat exchanger and electrical components having maximum electrical current ratings;

another extension feeder line means extending from one of the first and second tap units and being electrically connected through said first tap unit to the feeder line for carrying the three-phase power;

a third tap unit associated with the third merchandiser and having a third input receptacle for receiving said other extension feeder line means, fifth multi-positional connector means, tap wire means extending from the third input receptacle and connected to said fifth multi-position connector means, the fifth connector means having fifth line contact means disposed in equal triangulation and being connected to a respective one of the three phases of electrical power, a sixth multi-position connector means having sixth line contact means disposed in equal triangulation corresponding to said fifth line contact means, the fifth and sixth connector means being constructed and arranged for plug-in connection whereby any one of the line contact means of the fifth connector means may be connected to any one of the line contact means of the sixth connector means;

a third case power line electrically connected to the sixth connector means and to the electrical components of the third merchandiser for providing power to the third merchandiser.

15. The merchandiser line-up of claim 12 wherein the first connector means are differently marked adjacent to each line contact means to designate which phase of power is connected to the line contact means.

16. The merchandiser line-up of claim 15 wherein the second connector means are differently marked adjacent to each terminal.

17. The merchandiser line-up of claim 16 wherein the first and third connector means of the tap units have substantially identical markings and the second and fourth connector means of the tap units have substantial identical markings, the first and second connector means of the first tap unit being connected together in a first orientation, and the third and fourth connector means of the second tap unit being connected together in a second orientation different from the first orientation whereby different phases of electrical power are provided to electrical components in the first and second merchandisers.

18. The merchandiser line-up of claim 12 wherein the extension feeder line means is constructed and arranged for plug-in connection between the first and second tap units.

19. The merchandiser line-up of claim 18 wherein the extension feeder line means comprises a flexible conduit and electrical wiring disposed in the conduit carrying the three-phase electrical power.

20. The merchandiser line-up of claim 12 wherein the first and second connector means of the first tap unit comprises a centrally located electrical ground contact whereby to establish a ground connection between the first and second connector means regardless of the orientation of the first and second line contact means as plugged into each other.

21. The merchandiser line-up of claim 12 wherein the first and second connector means of the first tap unit comprises a pair of electrical neutral contacts, each neutral contact being located between a respective pair of line contact means whereby to establish at least one neutral connection between the first and second connector means regardless of the orientation of the first and second line contact means as plugged into each other.

22. A line-up of first refrigerated merchandisers commonly serviced by a cooling source and wired in a single electrical circuit from a circuit breaker box, the line-up comprising:

a first refrigerated merchandiser including a heat exchanger and electrical components having maximum electrical current ratings;

a second refrigerated merchandiser located generally adjacent to the first merchandiser, the second merchandiser including a heat exchanger and electrical components having maximum electrical current ratings;

a feeder line constructed and arranged for connection to the circuit breaker box for carrying three-phase electrical power in an electrical current greater than the highest maximum electrical current rating of the electrical components of the first and second merchandisers;

a first tap unit including a first tap unit box mounted on the first merchandiser, the first tap unit having a receptacle in the tap unit box for receiving the feeder line, overcurrent protection means mounted on the first tap unit box, tap wire means extending from the receptacle and connected to said overcurrent protection means inside of the first tap unit box, a first connector electrically connected to said overcurrent protection means, a second connector constructed and arranged for plug-in connection to the first connector inside of the first tap unit box;

a first case power line electrically connected to the second connector and being connected to the electrical components of the first merchandiser for providing power to the first merchandiser;

a flexible extension feeder line constructed and arranged for plug-in connection to the first tap unit for electrical connection with the feeder power line for carrying the three-phase power from the first tap unit;

a second tap unit including a second tap unit box mounted on the second merchandiser, the second tap unit having a receptacle constructed and arranged for plug-in connection of the extension feeder line therein, overcurrent protection means mounted on the second tap unit box, tap wire means extending from the receptacle and connected to said overcurrent protection means inside of the second tap unit box, a first connector electrically connected to said overcurrent protection means inside of the second tap unit box, a second connector constructed and arranged for plug-in connection with the first connector inside of the second tap unit box;

a second case power line electrically connected to the second connector inside of the second tap unit box and being connected to the electrical components of the second merchandiser for providing power to the second merchandiser;

whereby the first and second merchandisers are wired in a single electrical circuit from the feeder line.

23. The merchandiser line-up of claim 22 further comprising:

a third refrigerated merchandiser located generally adjacent to one of the first and second merchandisers, the third merchandiser including a heat exchanger and electrical components having maximum electrical current ratings;

another flexible extension feeder line extending from one of the first and second tap units and electrically connected to the feeder line for carrying the three-phase power;

a third tap unit including a third tap unit box mounted on the third merchandiser, the third tap unit having a receptacle for receiving said other extension feeder line, overcurrent protection means mounted on the third tap unit, tap wire means extending from the receptacle and connected to said overcurrent protection means inside of the third tap unit box, a first connector electrically connected to said overcurrent protection means inside of the third tap unit box, a second connector electrically connected to the electrical components of the third merchandiser, the first and second connectors being constructed and arranged for plug-in connection inside of the third tap unit box;

a third case power line electrically connected to the second connector inside the third tap unit box and connected to the electrical components of the third merchandiser for providing power to the third merchandiser.

24. A wiring system for commercial refrigeration comprising a first refrigerated merchandiser having cooling means and electrical components to be wired from a three-phase electrical power source, the wiring system comprising a first tap unit having a power junction receptacle operatively connected to receive three-phase electrical power from said power source, said first tap unit having a first multi-positional coupler means with first, second and third terminals constructed and arranged to receive the three phases of electrical power from within the receptacle, and a second multi-positional coupler means having plural terminals for selective connection with different combinations of said first, second and third terminals of said first coupler means, and said first tap unit receptacle being further constructed and arranged to provide continuation three-phase power connections to other tap unit means for other refrigerated merchandisers.

* * * * *